United States Patent [19]

Klein

[11] 3,939,675

[45] Feb. 24, 1976

[54] APPARATUS FOR DYEING AND PRINTING MATERIALS HAVING IMPROVED MEANS FOR SUPPORT THEREOF

[75] Inventor: Norman E. Klein, Inman, S.C.

[73] Assignee: Deering Milliken Research Corporation, Spartanburg, S.C.

[22] Filed: May 17, 1974

[21] Appl. No.: 471,109

[52] U.S. Cl. ..... 68/205 R; 134/167 C; 239/112

[51] Int. Cl.[2] ..... D06B 1/02

[58] Field of Search ..... 68/205 R; 15/312 R; 134/166 C, 167 C, 168 C, 169 C; 239/112, 186

[56] References Cited

UNITED STATES PATENTS 3,271,102 9/1966 Morgan ..... 68/205 R 3,688,530 9/1972 Harris et al. ..... 68/205 R

*Primary Examiner*—Richard E. Aegerter
*Assistant Examiner*—L. Footland
*Attorney, Agent, or Firm*—L. J. Wilburn, Jr.; H. William Petry

[57] ABSTRACT

Apparatus to apply dyes to a moving material to print the same which employs dye applicator gun bars to direct a plurality of streams of dye onto the moving sheet in a predetermined pattern, and wherein means are provided for accurately positioning and adjusting the gun bars on their support frame to facilitate accurate placement of the dye streams on the moving material during the printing operation.

8 Claims, 10 Drawing Figures

APPARATUS FOR DYEING AND PRINTING MATERIALS HAVING IMPROVED MEANS FOR SUPPORT THEREOF

This invention relates to the application of dyestuffs to textile materials and, more particularly, to the printing of textile fabrics having relatively porous surfaces, such as pile carpets.

Textile fibers and fabric materials have long been colored with natural and synthetic dyes, and, in particular, printed by color decoration of the surface or surfaces of the materials in definite repeated forms and colors to form a pattern. The color printing of textile fabrics has been accomplished in various ways. Earlier forms of printing used carved blocks charged with colored paste pressed against the fabric. Subsequently, speed of printing has been increased by the development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

More recently, it has been proposed to print textile fabrics, including pile carpets, by the programmed spraying or jetting of plural colored dyes onto the surface of a moving fabric. Typical of such processes and apparatus are described in U.S. 3,443,878; U.S. 3,570,275; and British Pat. No. 978,452. Generally, such apparatus consists of a plurality of dye applicator bars spaced along the direction of movement of the textile material and each containing multiple dye nozzles or jets extending transversely across the moving material. Each jet may be activated by suitable electric, pneumatic, or mechanical means to dispense dyes onto the moving material in a desired sequence, and pattern control of the jets may be accomplished by suitable programming means, such as coded punch tapes, magnetic tapes, computers, and the like.

U.S. Pat. Nos. 3,443,878 and 3,570,275 disclose specific means for applying streams of dyes to print a fabric by use of continuously flowing streams of dyes which are deflected by a stream of air to either impinge the dyestream upon the fabric or recirculate it to a reservoir. Control of such systems to form printed patterns may be accomplished by various of the aforementioned programming and control means.

In order to provide a greater variety of colors or shades of colors to the fabrics by use of such spray printing apparatus, it has also been proposed to apply different colors to the same locations or areas of the fabric to thereby blend primary colors in situ.

It can be appreciated that in the application of different colored dyes to the surface of textile fabrics, it is extremely important to accurately place each dyestuff on the fabric, particularly when intricate patterns are being printed and when in situ blending is employed. In dyeing relatively porous textile fabrics, such as pile carpets, it is also important that a carefully controlled amount of dye be applied to each dyed area on the pile surface to ensure optimum penetration of the dye color to the depth of the pile fiber without undesirable spread of the color into adjacent areas of the fabric. U.S. Pat. No. 3,393,411 discusses such a problem of dye penetration of pile carpet and suggests controlling the flow rate of the dyestuff and the speed of movement of the pile carpet past the dye application point to provide the desired amount of dye to the carpet.

In printing pile carpets with detailed patterns of colors, it can be appreciated that the dye jet applicators are very closely spaced relative to each other to permit dyeing in fine detail on the pile surface. The mounting, construction or programmed control of various gun bars for application of various dyestuffs to moving webs are also disclosed in one or more of British Pat. Nos. 1,201,598; 1,201,600; 1,201,599; and 1,202,345.

Also, in the pattern printing of wide yardage goods of continuous lengths, such as pile carpets wherein the widths being printed may be as much as 15 feet, it can be appreciated that it is highly desirable and necessary that the very large and heavy dye applicator gun bars be well supported and accurately aligned throughout their lengths to ensure accurate and proper placement of the jets of dye being applied across the entire width of the goods being printed. One such design and arrangement of gun bar construction is disclosed in commonly assigned co-pending U.S. Pat. application Ser. No. 430,527, filed Jan. 3, 1974.

The present invention is concerned with further improvements in apparatus for the jet printing of textile products including pile fabrics to facilitate accurate placement of desired amounts of dyes at specific locations on or in the surface of the pile fabrics to improve pattern definition in such fabrics. More specifically, the present invention is directed to means for accurately positioning a dye applicator gun bar utilized to apply multiple streams or jets of dyestuff across the width of a moving textile material to be printed.

The invention will be better understood by reference to the accompanying drawings which disclose a specific embodiment, and wherein.

Figure 3:
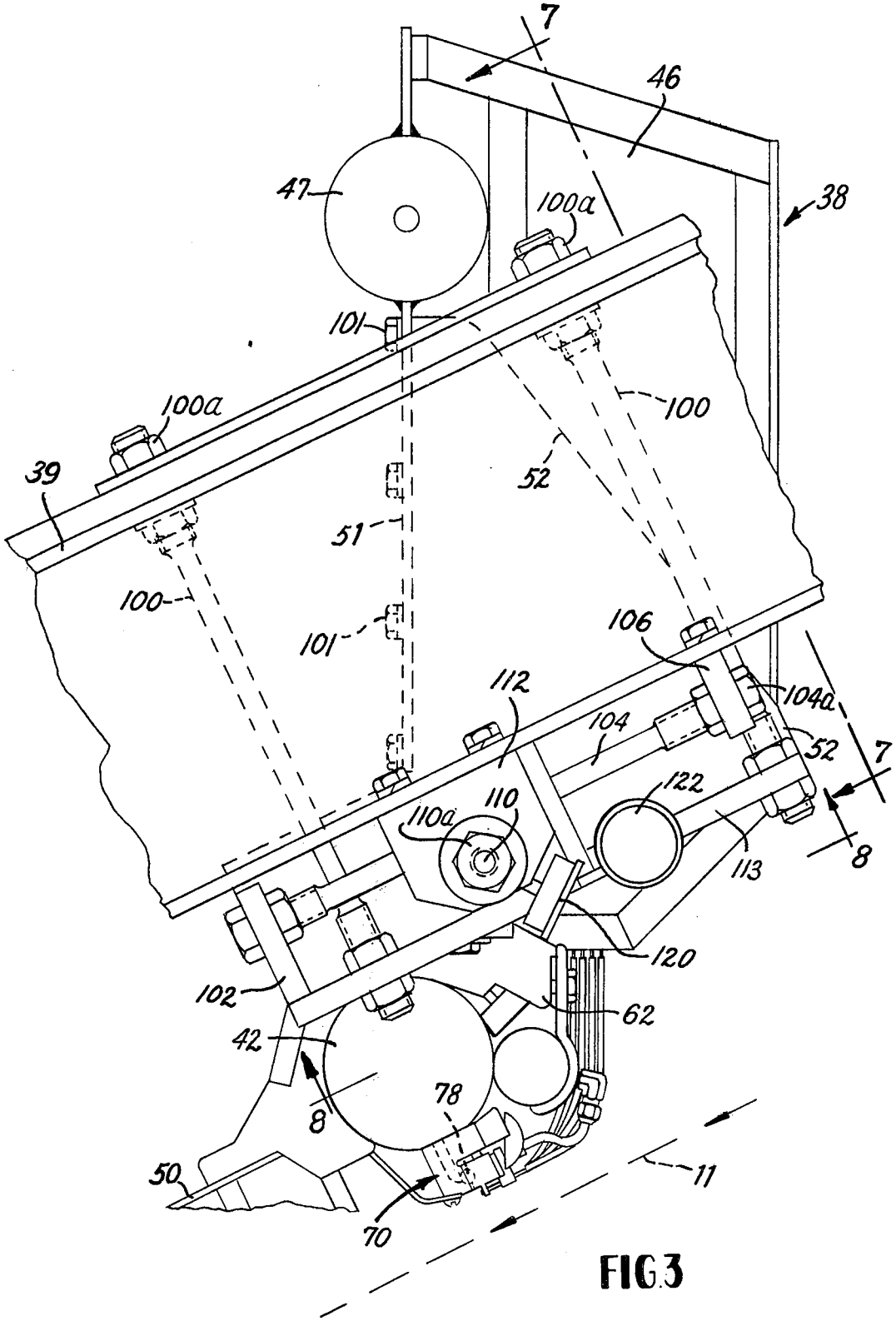
FIG. 3 is a further enlarged side elevation view, with parts broken away showing an individual dye applicator gun bar of the apparatus of FIGS. 1 and 2.
Figure 5:
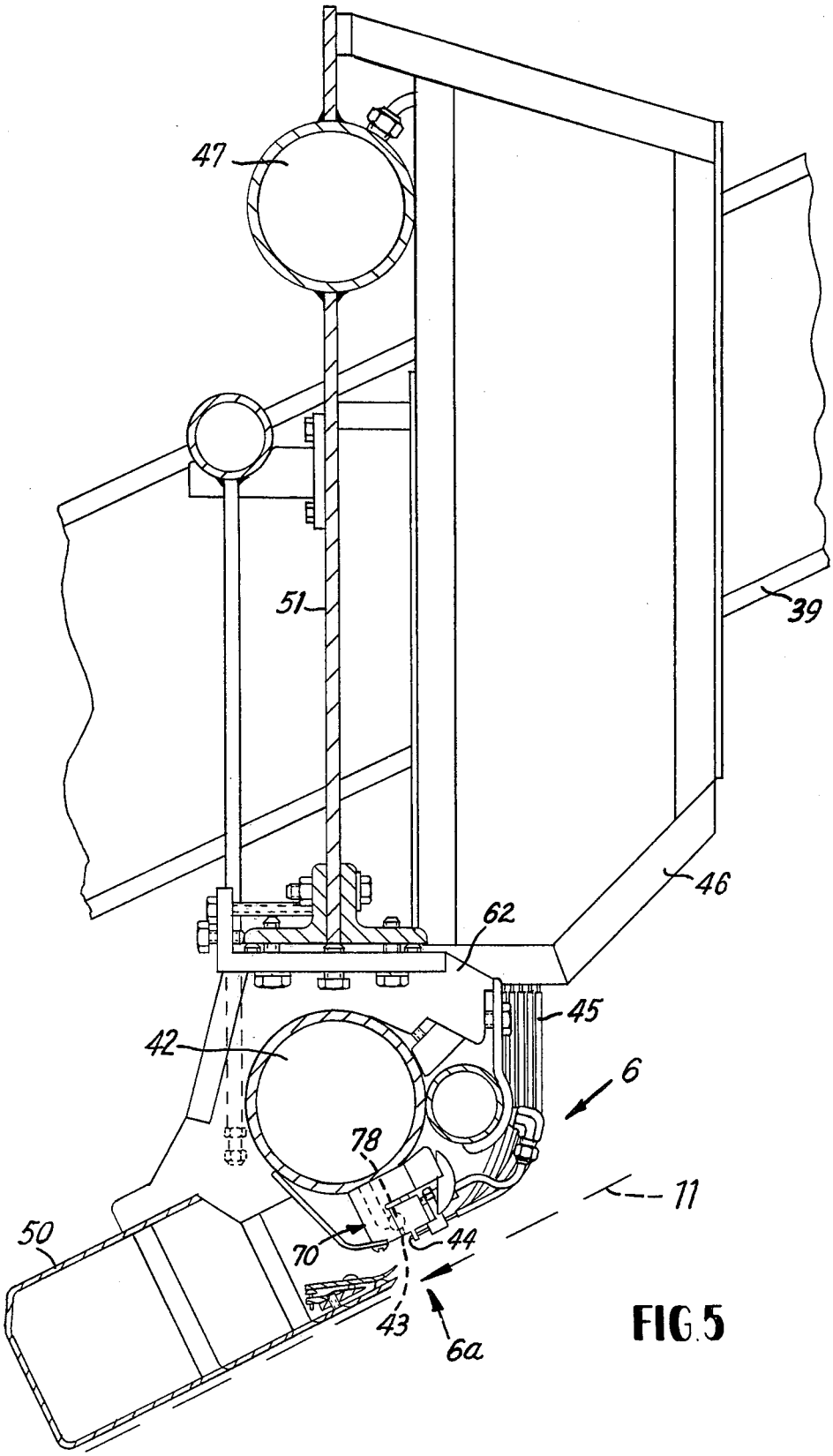
FIG. 5 is a side elevation view, with portions in section, of the gun bar of FIG. 3.
Figure 7:
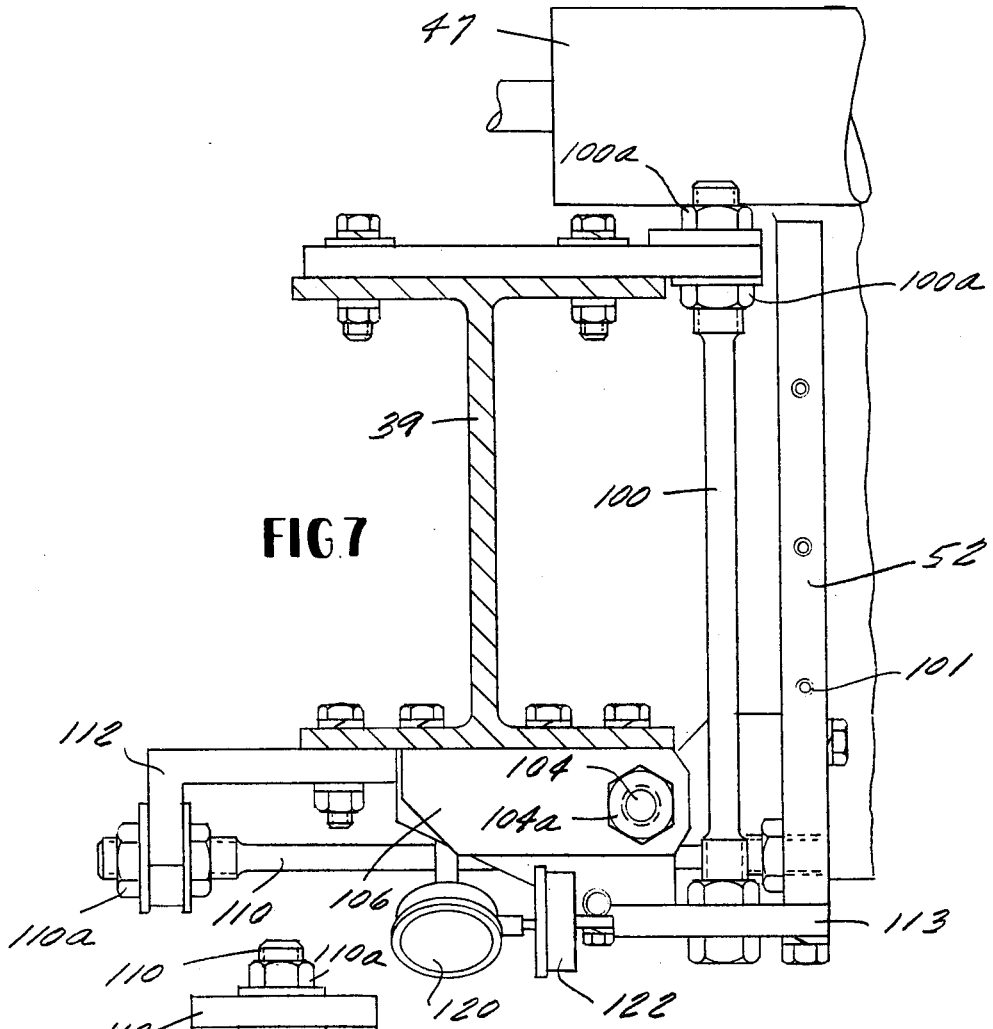
Figure 8:
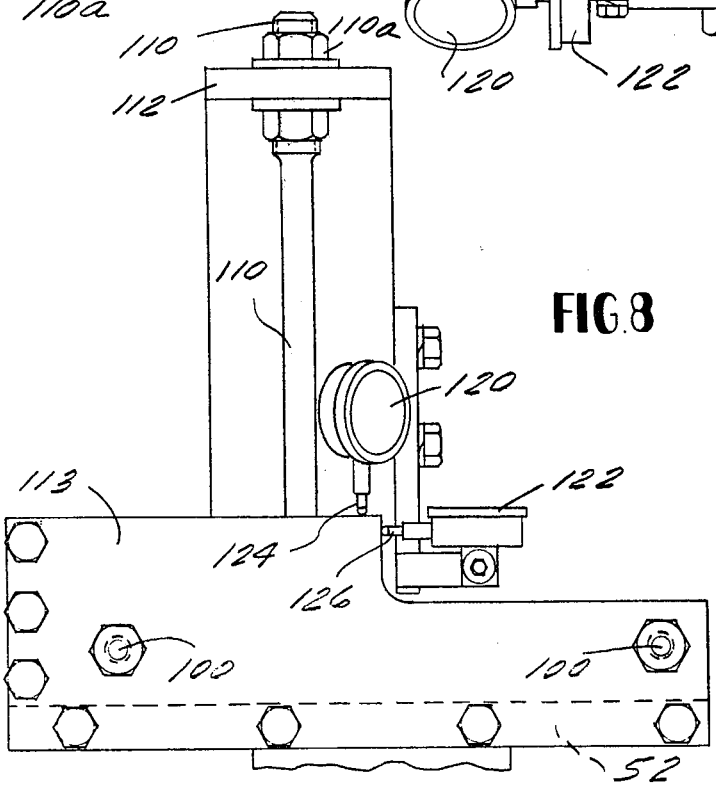
Figure 9:
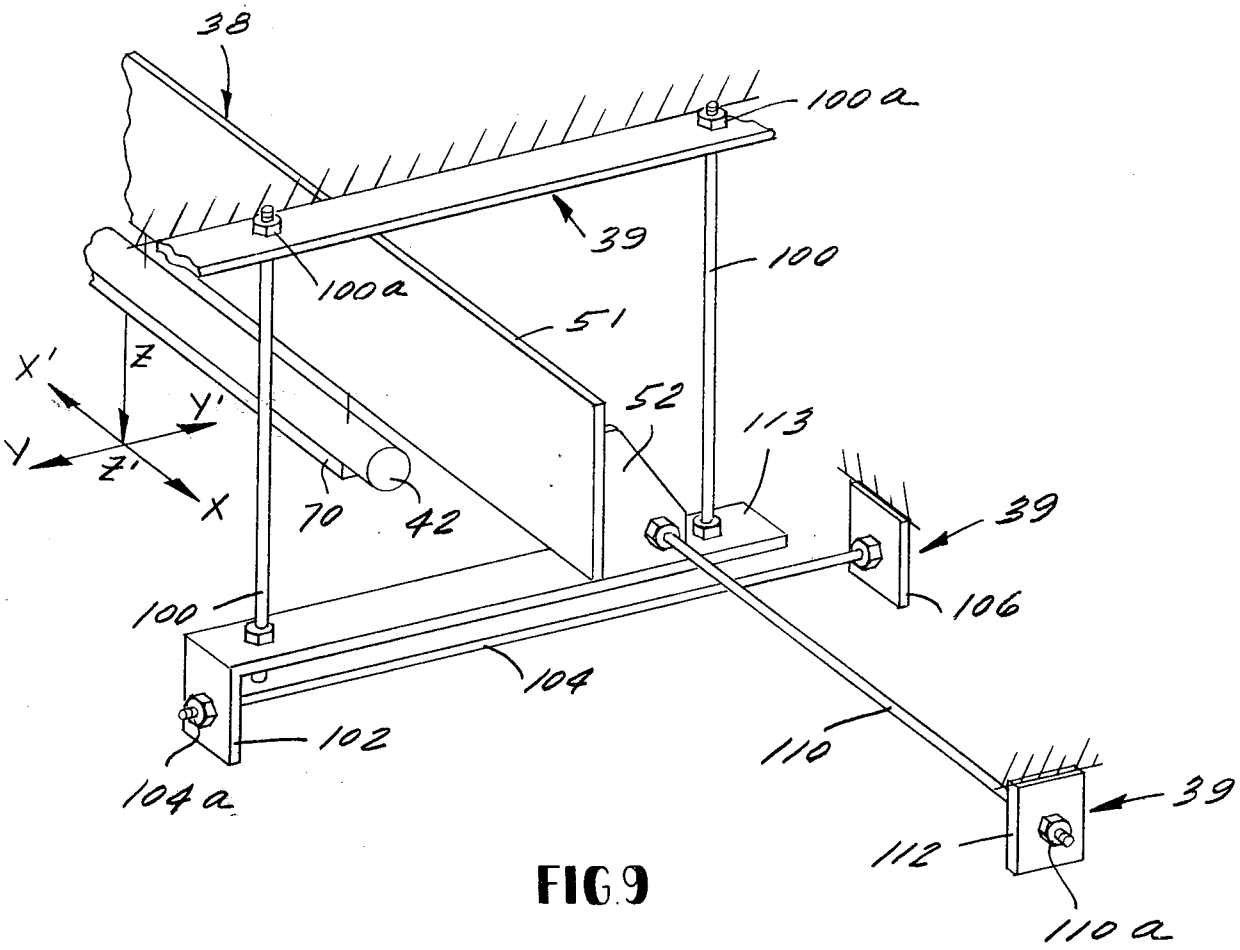

FIG. **6*a* is an enlarged view of a portion of the dye jet applicator section of the gun bar, looking in the direction of the arrow 6*a* of FIG. 5** and showing the dye jet orifices and their associated air supply conduits for deflecting the dye streams;

FIG. 7 is a view of the gun bar support means looking in the direction of arrows 7—7 of FIG. 3;

FIG. 8 is a view of the gun bar support means looking in the direction of arrows 8—8 of FIG. 3; and FIG. 9 is a perspective schematic view illustrating the gun bar mounting means shown in FIGS. 3, 7 and 8, with only certain portions of the support frame and gun bar shown for the sake of better illustrating the adjustable features of the support means.

Figure 1:
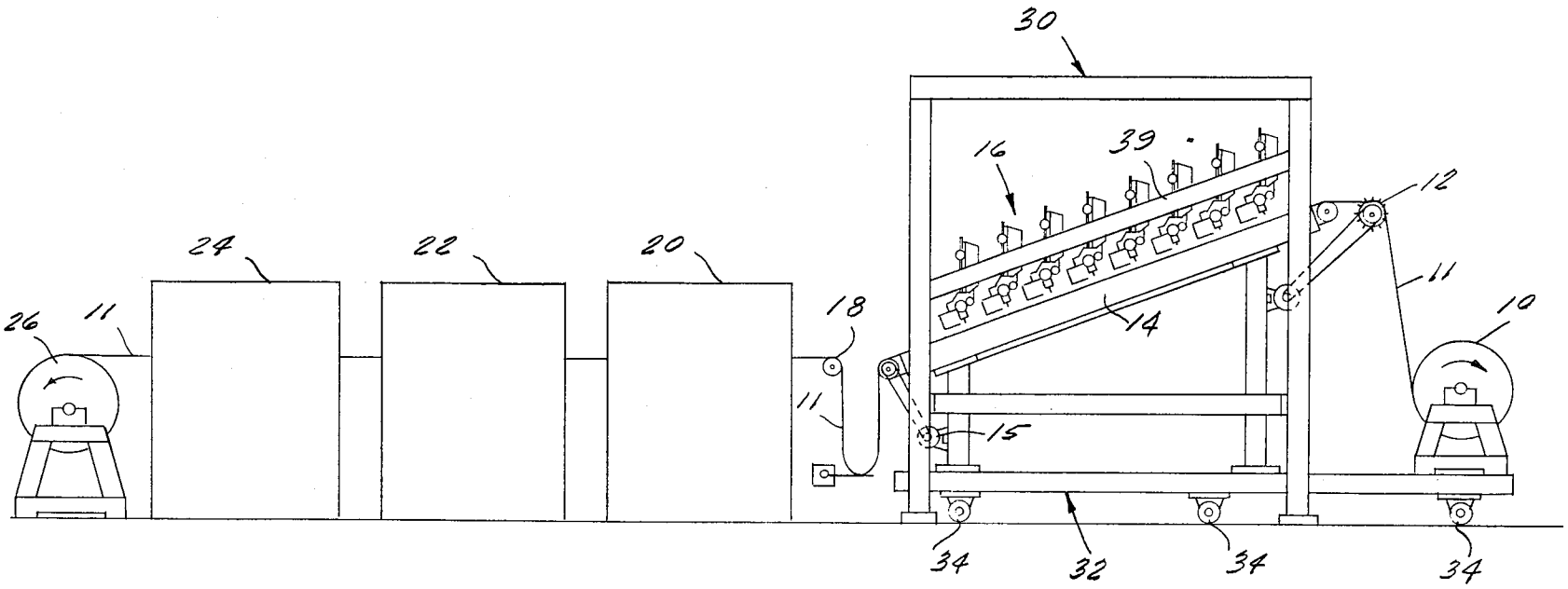
FIG. 1 is a schematic side elevation of an apparatus for the jet dyeing of textile materials.

Referring more specifically to the drawings, FIG. 1 shows a jet dyeing apparatus for color printing of moving materials, such as textile fabrics including pile carpets, tiles and the like. As shown and described, the apparatus consists of a fabric supply source such as a tufted carpet roll 10 from which a continuous length of pile carpet 11 is drawn by a driven pin roller 12 and is delivered onto an inclined conveyor 14 which is driven by suitable motor means 15 to convey the carpet 11 beneath a dye applicator gun bar section 16, each gun bar of which dispenses plural streams of dye onto the carpet during its passage. The gun bars may be provided with different colored dyes and each of the plural streams of dye is programmed in suitable manner so as to apply the dyes to the surface of the carpet in a desired pattern.

The printed carpet leaving the conveyor 14 is directed by suitable conveying means, such as guide rolls 18, sequentially through a steam chamber 20, a water washer 22, and a dryer 24 where the printed carpet is treated in conventional manner to fix the dyes, remove excess dye, and dry the printed carpet, respectively. The carpet is then collected on a roll 26. Details of the dye fixing steam chamber, washer, and dryer do not form a part of the present invention and conventional apparatus for performing such conventional practices may be employed.

Figure 2:
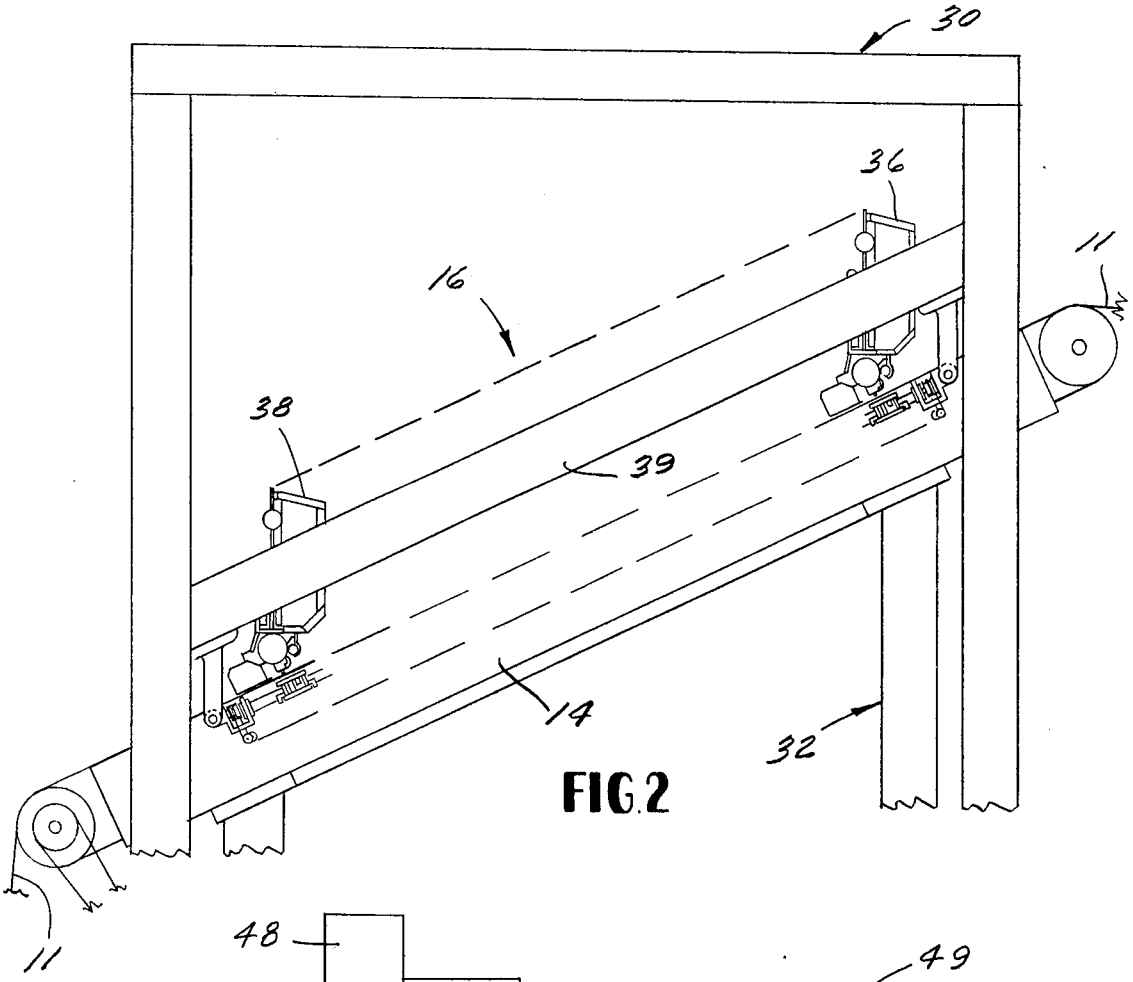
FIG. 2 is an enlarged schematic side elevation, with parts broken away, of the jet dye applicator gun bar section of the apparatus of FIG. 1, showing in more detail the arrangement and relation of the jet gun bars to the conveying means to transport the materials to be printed.

FIG. 2 is an enlarged side elevation, with portions broken away, of the gun bar section 16 and conveyor 14. As seen in both FIGS. 1 and 2, the gun bar section 16 and conveyor 14 are supported on a suitable frame 30 which includes a movable section 32 mounted on rollers 34 (FIG. 1) to permit removal of the conveyor 14 from beneath the gun bar section to facilitate cleaning, repair, and alignment of the gun bars.

As shown, gun bar section 16 includes a plurality of gun bars spaced along the conveyor 14 just above the path of travel of the carpet. Each gun bar is provided with a suitable color dye and is programmed to apply the dye from selected orifices therein to corresponding portions of the surface of the moving carpet. For convenience, only the first and last gun bars 36, 38 of the gun bar section 16 are shown in FIG. 2. The number of gun bars may be varied, as desired, depending on the particular color requirements of the pattern to be applied to the fabric. The gun bars are of substantially identical construction and extend across the conveyor and path of travel of the carpet thereon.

Figure 4:
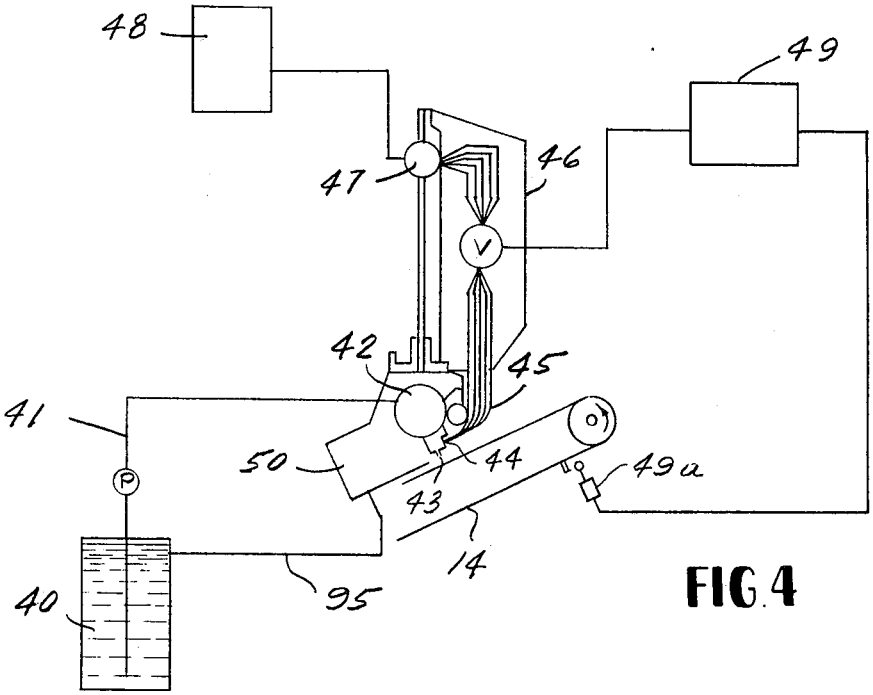
FIG. 4 is a schematic diagram of the system for supplying dye to and from, and air under pressure to, each of the gun bars, together with related control means for programming same.
Figure 6:
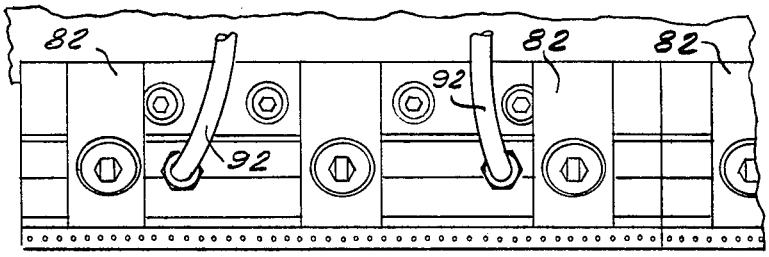
FIG. 6 is an enlarged view of a portion of the dye jet applicator section of the gun bar, looking in the direction of arrow 6 of FIG. 5, with portions broken away and removed to better show the mounting means for the dye jet applicator section and the associated air deflection means.
Figure 6A:
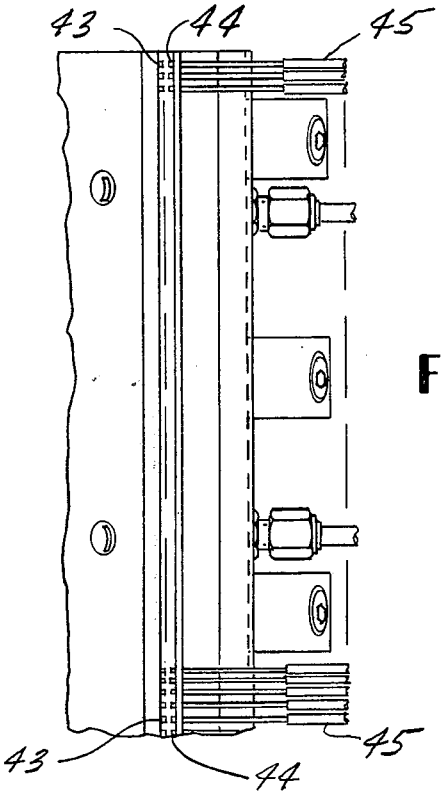

Each gun bar extends across the width of conveyor 14 transversely to the direction of movement of the carpet and contains a plurality of jet orifices closely positioned along the bar to direct dye in narrow streams toward the surface of the carpet as it passes thereby. As best seen in FIG. 4, each gun bar includes a separate dye reservoir tank 40 which supplies liquid dye by means of pump and conduit means 41 under pressure to a manifold pipe 42 of the gun bar which communicates with the individual jet orifices 43 spaced along the length of the bar (FIGS. 6 and 6a). During operation, liquid dye is expelled continuously in small streams or jets from the orifices toward the material to be printed.

Positioned adjacent and at a right angle to the outlet of each jet orifice is an outlet 44 (FIG. 5) of an air supply tube 45, each of which communicates with a separate solenoid valve, illustrated collectively by the symbol V (FIG. 4). The solenoid valves, which are of the electric to fluidic interface type, such as LIF 180D3A12 made by The Lee Company of Westbrook, Connecticut, are suitably supported on mounting cards in a card housing 46 and are supplied with pressurized air from a communicating manifold 47 and air compressor 48. Although a single valve symbol V is employed for convenience, it is to be understood that a solenoid valve and individual air supply tube is provided to serve each jet orifice of each gun bar such that individual streams of dye can be individually controlled.

The valves are controlled electrically by a pattern control device 49 to normally provide streams of air to impinge against the continuously flowing dyestreams and deflect the same into a catch basin or trough 50 from which the dye is recirculated to dye reservoir tank 40. The pattern control device 49 for operating the solenoid valves may comprise various conventional control means, such as a computer with magnetic tape transport for pattern information storage. Information from control means 49 is fed to operate the solenoid valves off and on sequentially to print the carpet in a desired pattern as it passes beneath the set of gun bars.

In operation of the presently disclosed apparatus with the pattern control device supplying no information, dye under pressure is continuously supplied in a stream from each jet orifice 43 toward the textile material to be printed. Every solenoid valve is normally open to supply streams of air to impinge against the continuously flowing dye streams and deflect them all into the catch troughs of the gun bars for recirculation. As the first of the carpet to be printed passes beneath the first gun bar and the pattern control device is actuated, as by a trip switch 49*a* on the conveyor, certain of the normally open solenoid air valves are closed so that the corresponding dye streams are not deflected but impinge directly upon the textile material. Thus, by cutting on and off the solenoid air valves in a desired sequence, a printed pattern of dye is placed on the carpet during its passage.

The details of the gun bar construction are best shown in FIGS. 3 and 5 which are an end view and a partial sectional view, respectively, of a portion of a gun bar 38. As seen, the gun bar is composed of a main, vertically disposed structural support plate 51 which extends the length of the gun bar across the path of material movement. Attached to the plate at its upper end is the air supply manifold pipe 47, and attached to the lower flanged end of the plate by a suitable bracket and clamp means 62 is the dye supply manifold pipe 42. Attached to and communicating with the dye supply manifold pipe is a jet applicator section 70 which has a dye receiving cavity or chamber 78 connected to the dye manifold 42 to pass dye to the plurality of dye yet orifices 43 (FIG. 6*a*) which emit streams of dye onto the material to be printed, as hereinbefore described. The details of the gun bar construction form the subject of co-pending, commonly assigned U.S. patent application Ser. No. 471,110, filed May 17, 1974.

It can be appreciated that it is highly desirable and necessary to accurately align the gun bars end to end both with respect to each other and to the moving carpet to ensure that the pattern is accurately printed on the carpet surface. Since the gun bars are 12 to 15 feet long in order to print broadloom carpets, it can be appreciated that they are quite heavy and that extremely fine adjustment is necessary to properly position the gun bars along their length. To accomplish this end, means are provided for suspending each end of the gun bars from the diagonal beam 39 at each end of support frame 30 by a pair of threaded hang rods or bolts 100. As best seen in FIGS. 3 and 7–9, the elongate support plate 51 of each gun bar is attached at each end to a flanged, generally triangular end plate 52 by bolts 101. A first flange portion 102 connected to the triangular end plate is connected by an adjustable threaded bolt 104 which extends to a fixed shoulder 106 on diagonal support beam 39 of the support frame 30. In like manner, the surface of the triangular plate 52 is adjustably connected by a threaded bolt 110 which extends to a fixed shoulder 112 on beam 39 of frame 30. The lower ends of the pair of bolts or rods 100 are attached to a platform portion 113 of triangular plate 52. Thus, the adjustable bolts, pair 100, 104, 110 are positioned at right angles to each other so as to impart to the triangular plate member and gun bar a force acting in each of three directions.

FIG. 9 shows the adjustable features of the fastening means of the present invention in perspective schematic form. For sake of clearer illustration, flange portion 102 is shown extending downwardly instead of upwardly, as seen in FIG. 3, so that the bolts and their directional relationships are more clearly seen. As can be seen, by adjusting the effective length of any of the bolts (pair 100, 104, 110) between their points of attachment to the gun bar and the fixed surfaces of the support beam 39, forces are produced to deflect or bend the other bolts in small increments to accurately reposition and adjust the gun bar at each end.

Thus, by turning the nuts 100*a* on either of the threaded ends of bolts 100, the gun bar may be moved in the Z–Z′ directions (which is the direction of the flow of the dye streams onto the carpet), as indicated by the vector diagram in the figure. Similarly, adjustment of nuts 104*a* on the threaded ends of bolt 104 produces a force to adjust the position of the gun bar in the Y–Y′ directions, while adjustment of nuts 110*a* produce force to adjust the position of the gun bar in the X–X′ directions. Although only a single nut is shown on each end of the bolts in FIG. 9, it can be seen in FIG. 3 that a pair of nuts is employed to secure the bolts on either side of the force-transmitting and force-receiving surfaces of the frame 30 and gun bar end plates 52.

To facilitate the aforementioned adjustment and accurate alignment of the gun bars, dial indicators 120, 122 are mounted on the flange portions of the diagonal support beam 39 of the frame. The dial indicators register a position of their plunger elements 124, 126 which are aligned respectively with the X and Y axes of movement of the gun bar and engage corner surfaces of platform portion 113 of the gun bar plate 52 (note particularly FIG. 8). Thus, as the position of the gun bar is changed by manipulation of the nuts of the support rods 110, 104 a change in readings of the dials can be observed. These readings can thereafter be used as highly accurate bench marks to reset the gun bars in a desired position as well as to compare and correlate any possible change in the position of the different gun bars of the apparatus.

That which is claimed is:

1. In apparatus for applying dye to a moving material to print a pattern thereon including means for moving the material in a path of treatment, an elongate dye jet gun bar having a plurality of dye emitting jet orifices along the bar for directing dye in plural streams onto the material, a support frame for positioning the gun bar adjacent the path of material treatment, and means for attaching the gun bar to the support frame; the improvement wherein said attaching means comprises elongate resilient rod means at each end of said gun bar having one end attached to said gun bar and the other end attached to said support frame to supportingly suspend said gun bar on said support frame, and means operatively connecting said gun bar and said frame for applying multidirectional forces to said gun bar to bend said resilient elongate rod means and thereby adjustably position said gun bar relative to said support frame and said path of material treatment.

2. Apparatus as defined in claim 1 wherein said means for applying multidirectional forces to said gun bar comprises means for imparting a force in a first direction against said gun bar, generally normal to the elongate axis of said elongate rod means and means for applying a force in a second direction against said gun bar generally normal to the longitudinal axis of said rod means and generally at a right angle to said first force imparting means.

3. Apparatus as defined in claim 2 wherein said force-imparting means comprise first and second force-receiving surfaces on said gun bar and corresponding first and second force-imparting surfaces on said frame, and means for transmitting force from said frame surfaces to said gun bar receiving surfaces.

4. Apparatus as defined in claim 3 wherein said force-transmitting means comprise connecting means between said force-imparting and force-receiving surfaces, and means for varying the length of said connecting means between said surfaces to transmit forces therebetween.

5. Apparatus as defined in claim 4 wherein said connecting means comprise resilient rods extending between and connected to said surfaces, and said length varying means comprise adjustable fastening means on end portions of said rods for varying the length of said rods between said surfaces.

6. Apparatus as defined in claim 1 including indicator means operatively attached to said gun bar and said support frame for presenting a visual indication of the position of said gun bar relative to said support frame.

7. Apparatus as defined in claim 6 wherein said indicator means comprise means positioned at each end of said gun bar for indicating the position of the corresponding end of the gun bar with respect to the support frame.

8. Apparatus as defined in claim 1 wherein said rod means for supportingly suspending said gun bar is positioned with its longitudinal axis generally parallel to the plural streams of dye directed onto the material to be printed.

* * * * *